US006060227A

United States Patent [19]

Büscher et al.

[11] Patent Number: 6,060,227

[45] Date of Patent: May 9, 2000

[54] COLOR NEGATIVE FILM

[75] Inventors: Ralf Büscher, Lohmar; Peter Bell, Köln; Hans-Ulrich Borst, Elsdorf; Lothar Rosenhahn; Jörg Siegel, both of Köln; Thomas Stetzer, Langenfeld, all of Germany

[73] Assignee: Agfa-Gevaert NV, Belgium

[21] Appl. No.: 09/122,125

[22] Filed: Jul. 24, 1998

[30] Foreign Application Priority Data

Aug. 2, 1997 [DE] Germany ..... 197 33 524

[51] Int. Cl.[7] ..... G03C 1/46

[52] U.S. Cl. ..... 430/505; 430/506; 430/955; 430/956; 430/957; 430/958; 430/959; 430/544

[58] Field of Search ..... 430/505, 955, 430/956, 957, 958, 959, 543, 544, 506, 566

[56] References Cited

U.S. PATENT DOCUMENTS

| | | | |
|---|---|---|---|
| 4,859,578 | 8/1989 | Michno et al. | 430/544 |
| 4,912,025 | 3/1990 | Platt et al. | 430/544 |
| 5,441,857 | 8/1995 | Odenwalder et al. | 430/506 |
| 5,554,492 | 9/1996 | Tsoi | 430/566 |
| 5,605,786 | 2/1997 | Saito et al. | 430/505 |
| 5,622,817 | 4/1997 | Willsau et al. | 430/505 |

*Primary Examiner*—Geraldine Letscher
*Attorney, Agent, or Firm*—Connolly, Bove, Lodge & Hutz LLP

[57] ABSTRACT

A color negative film having a support, at least one blue-sensitive, yellow-coupling silver halide emulsion layer, at least one green-sensitive, magenta-coupling silver halide emulsion layer and at least one red-sensitive, cyan-coupling silver halide emulsion layer, wherein at least one of the color-sensitive silver halide emulsion layers consists of at least two sub-layers of differing photographic sensitivity, the coupler application rate in the most highly sensitive layer of the color sensitive silver halide emulsion layer, of which there is at least one, consisting of at least two sub-layers of differing photographic sensitivity, is no more than 0.05 mmol/$m^2$ and a development-promoting compound or a compound from the range of ETAR couplers and ACR couplers is used in the same or an adjacent layer, which compound, on reaction with the developer oxidation product (DOP), releases a development-promoting compound from the range of electron transfer agents (ETAR) or of binding groups having an affinity for silver (ACR), is distinguished by an improved grain/sensitivity ratio.

9 Claims, No Drawings

COLOR NEGATIVE FILM

This invention relates to a colour negative film having a support, at least one blue-sensitive, yellow-coupling silver halide emulsion layer, at least one green-sensitive, magenta-coupling silver halide emulsion layer and at least one red-sensitive, cyan-coupling silver halide emulsion layer, wherein at least one of the colour-sensitive silver halide emulsion layers consists of at least two sub-layers of differing photographic sensitivity, which film is distinguished by an improved grain/sensitivity ratio.

Attempts are constantly being made to make colour negative films more sensitive so that pictures of satisfactory quality may be produced even in poor lighting conditions or with very short exposure times. However, an increase in sensitivity is usually accompanied by unwanted impairment of grain. The object is accordingly to achieve an increase in sensitivity without degradation of grain or to improve grain while retaining a given sensitivity, i.e. to improve the sensitivity/grain ratio.

Many proposals have already been made to achieve this object, but scope still remains for improvement in the results achieved.

It has now been found that an improvement in the sensitivity/grain ratio is surprisingly achieved in a material of the above-stated type by the coupler application rate in the most highly sensitive layer of the colour sensitive silver halide emulsion layer, of which there is at least one, consisting of at least two sub-layers of differing photographic sensitivity, being no more than 0.05 mmol/$m^2$ and by using a development-promoting compound or a compound from the range of ETAR couplers and ACR couplers in the same or an adjacent layer, which compound, on reaction with the developer oxidation product (DOP), releases a development-promoting compound from the range of electron transfer agents (ETAR) or of binding groups having an affinity for silver (ACR).

Development accelerators are known, for example, from U.S. Pat. No. 4,292,400, GB 2 286 690 and DE 19 604 743, black-&-white auxiliary developers from EP 679 943, EP 679 942, EP 617 324 and U.S. Pat. No. 4,859,578, ACR compounds from U.S. Pat. No. 5 441 857 and ETAR couplers from EP 347 849 and U.S. Pat. No. 4,859,578.

In a preferred embodiment, the development-promoting compound is a development accelerator introduced in a quantity of between 0.01 and 100 mg/$m^2$ into the protective layer immediately above the most highly sensitive sub-layer, which contains less than 0.05 mmol of colour coupler/$m^2$.

In another preferred embodiment, the development-promoting compound is a development accelerator introduced in a quantity of between 0.01 and 50 mg/$m^2$ into the most highly sensitive sub-layer, which contains less than 0.05 mmol of colour coupler/$m^2$.

In another preferred embodiment, the development-promoting compound is a black-&-white auxiliary developer introduced in a quantity of between 1 and 3000 mg/$m^2$ into the protective layer immediately above the most highly sensitive sub-layer, which contains less than 0.05 mmol of colour coupler/$m^2$.

In another preferred embodiment, the compound which releases a development-promoting compound on reaction with DOP is an ETAR coupler introduced in a quantity of between 0.01 and 500 mg/$m^2$ into the most highly sensitive sub-layer, which contains less than 0.05 mmol of colour coupler/$m^2$.

In another preferred embodiment, the compound which releases a development-promoting compound on reaction with DOP is an ETAR coupler introduced in a quantity of between 1 and 500 mg/$m^2$ into the protective layer immediately above the most highly sensitive sub-layer, which contains less than 0.05 mmol of colour coupler/$m^2$.

In another preferred embodiment, the compound which releases a development-promoting compound on reaction with DOP is an ACR coupler introduced in a quantity of between 0.01 and 50 mg/$m^2$ into the most highly sensitive sub-layer, which contains less than 0.05 mmol of colour coupler/$m^2$.

In another preferred embodiment, the compound which releases a development-promoting compound on reaction with DOP is an ACR coupler introduced in a quantity of between 1 and 200 mg/$m^2$ into the protective layer immediately above the most highly sensitive sub-layer, which contains less than 0.05 mmol of colour coupler/$m^2$.

In another preferred embodiment, the protective layer arranged immediately above the most highly sensitive sub-layer containing less than 0.05 mmol of colour coupler/$m^2$ contains colour coupler in a quantity greater than that in the most highly sensitive sub-layer.

In another preferred embodiment, the material according to the invention is a colour negative film having a sensitivity of at least ISO 200.

The improvement in the sensitivity/grain ratio found according to the invention is surprising, on the one hand, because an increase in grain has generally been observed to accompany use of development-accelerating compounds or compounds which release a development-accelerating compound on reaction with DOP and, on the other hand, the most highly sensitive sub-layers containing the stated quantities of coupler have not achieved the required sensitivity and gradation.

Colour negative films consist of a support, onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

Colour negative films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer which prevents blue light from reaching the underlying layers is conventionally located between the green-sensitive and blue-sensitive layers. Possible options for different layer arrangements and the effects thereof on photographic properties are described in *J. Inf. Rec. Mats.,* 1994, volume 22, pages 183–193 and in *Research Disclosure* 38957, part XI (1996), page 624.

The number and arrangement of the photosensitive layers may be varied in order to achieve specific results. For example, all high sensitivity layers may be grouped together in one package of layers and all low sensitivity layers may be grouped together in another package of layers in a photographic film in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part IIA (1996), page 598.

Details of suitable silver halide emulsions, the production, ripening, stabilisation and spectral sensitisation thereof, including suitable spectral sensitisers, are given in *Research Disclosure* 37254, part 3 (1995), page 286, in *Research Disclosure* 37038, part XV (1995), page 89 and in *Research Disclosure* 38957, part VA (1996), page 603.

Colour negative films conventionally contain silver bromide/iodide emulsions, which may optionally also contain small proportions of silver chloride.

Details relating to colour couplers may be found in *Research Disclosure* 37254, part 4 (1995), page 288, in *Research Disclosure* 37038, part II (1995), page 80 and in *Research Disclosure* 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour negative films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86 and in *Research Disclosure* 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part XD) (1996), page 621.

The colour negative film may also contain UV light absorbing compounds, optical brighteners, spacers, filter dyes, formalin scavengers, light stabilisers, antioxidants, $D_{min}$ dyes, additives to improve stabilisation of dyes, couplers and whites and to reduce colour fogging, plasticisers (lattices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), page 607 and 610 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part IIB (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLES

Example 1

A colour photographic recording material for colour negative development was produced (layer structure 1A) by applying the following layers in the stated sequence onto a transparent cellulose triacetate film base. Quantities are stated per 1 $m^2$. The silver halide application rate is stated as the corresponding quantities of $AgNO_3$; the silver halides are stabilised with 0.5 g of 4-hydroxy-6-methyl-1,3,3a,7-tetraazaindene per 100 g of $AgNO_3$.

| | | |
|---|---|---|
| 1st layer | | (Anti-halo layer) |
| 0.3 | g | of black colloidal silver |
| 1.2 | g | of gelatine |
| 0.4 | g | of UV absorber UV-1 |
| 0.02 | g | of tricresyl phosphate (TCP) |
| 2nd layer | | (Micrate interlayer) |
| 0.25 | g | of $AgNO_3$ of a micrate Ag(Br, I) emulsion, average grain diameter 0.07 $\mu$m, 0.5 mol. % iodide |
| 1.0 | g | of gelatine |
| 3rd layer | | (Low sensitivity red-sensitive layer) |
| 2.7 | g | of $AgNO_3$ of a spectrally red-sensitised Ag(Br, I) emulsion containing 4 mol. % of iodide, average grain diameter 0.5 $\mu$m |
| 2.0 | g | of gelatine |
| 0.88 | g | of colourless coupler C-1 |
| 0.02 | g | of DIR coupler D-1 |
| 0.05 | g | of coloured coupler RC-1 |
| 0.07 | g | of coloured coupler YC-1 |
| 0.75 | g | of TCP |
| 4th layer | | (High sensitivity red-sensitive layer) |
| 2.2 | g | of $AgNO_3$ of spectrally red-sensitised Ag(Br, I) emulsion, 12 mol. % iodide, average grain diameter 1.0 $\mu$m, |
| 1.8 | g | of gelatine |
| 0.19 | g | of colourless coupler C-2 |
| 0.17 | g | of TCP |
| 5th layer | | (Interlayer) |
| 0.4 | g | of gelatine |
| 0.05 | g | of white coupler W-1 |
| 6th layer | | (Low sensitivity green-sensitive layer) |
| 1.9 | g | of $AgNO_3$ of a spectrally green-sensitised Ag(Br, I) emulsion, 4 mol. % iodide, average grain diameter 0.35 $\mu$m, |
| 1.8 | g | of gelatine |
| 0.54 | g | of colourless coupler M-1 |
| 0.24 | g | of DIR coupler D-1 |
| 0.065 | g | of coloured coupler YM-1 |
| 0.6 | g | of TCP |
| 7th layer | | (High sensitivity green-sensitive layer) |
| 1.25 | g | of $AgNO_3$ of a spectrally green-sensitised Ag(Br, I) emulsion, 9 mol. % iodide, average grain diameter 0.8 $\mu$m, |
| 1.1 | g | of gelatine |
| 0.195 | g | of colourless coupler M-2 |
| 0.05 | g | of coloured coupler YM-2 |
| 0.245 | g | of TCP |

-continued

8th layer (Yellow filter layer)

| | | |
|---|---|---|
| 0.09 | g | of yellow colloidal silver |
| 0.25 | g | of gelatine |
| 0.08 | g | of scavenger SC-1 |
| 0.40 | g | of formaldehyde scavenger FF-1 |
| 0.08 | g | of TCP |

9th layer (Low sensitivity blue-sensitive layer)

| | | |
|---|---|---|
| 0.9 | g | of a spectrally blue-sensitised Ag(Br, I) emulsion, 6 mol. % iodide, average grain diameter 0.6 $\mu$m |
| 2.2 | g | of gelatine |
| 1.1 | g | of colourless coupler Y-1 |
| 0.037 | g | of DIR coupler D-1 |
| 1.14 | g | of TCP |

10th layer (High sensitivity blue-sensitive layer)

| | | |
|---|---|---|
| 0.6 | g | of $AgNO_3$ of a spectrally blue-sensitised Ag(Br, I) emulsion, 10 mol. % iodide, average grain diameter 1.2 $\mu$m, |
| 0.6 | g | of gelatine |
| 0.2 | g | of colourless coupler Y-1 |
| 0.003 | g | of DIR coupler D-1 |
| 0.22 | g | of TCP |

-continued

11th layer (Micrate layer)

| | | |
|---|---|---|
| 0.06 | g | of $AgNO_3$ of a micrate Ag(Br, I) emulsion, average grain diameter 0.06 $\mu$m, 0.5 mol. % iodide, |
| 1 | g | of gelatine |
| 0.3 | g | of UV absorber UV-2 |
| 0.3 | g | of TCP |

12th layer (Protective & hardening layer)

| | | |
|---|---|---|
| 0.25 | g | of gelatine |
| 0.75 | g | of hardener of the formula |

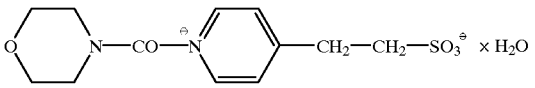

such that, once hardened, the overall layer structure had a swelling factor of ≦3.5.

Substances used in Example 1:

UV-1

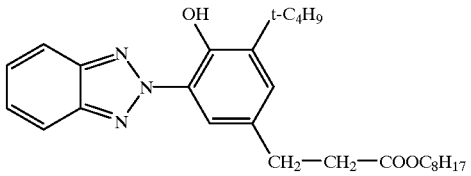

UV-2

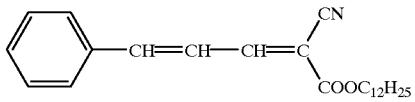

C-1

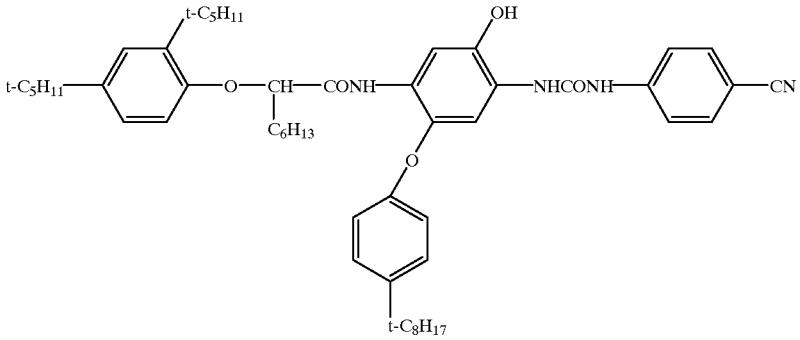

C-2

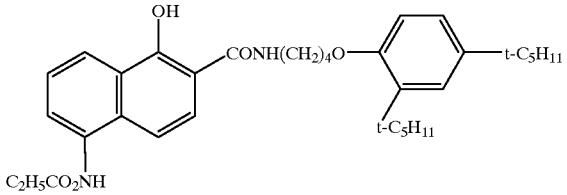

-continued
RC-1
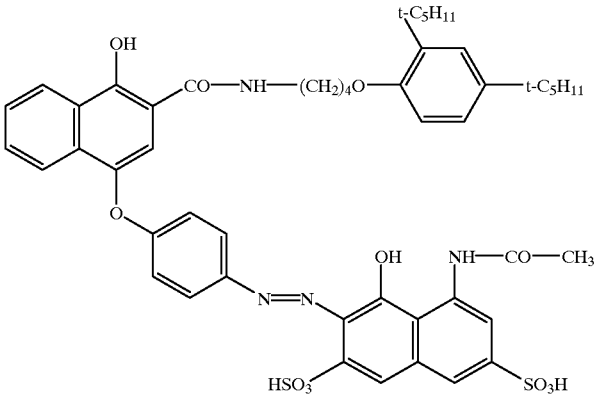
M-1
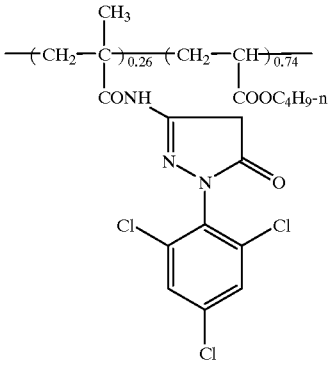
M-2
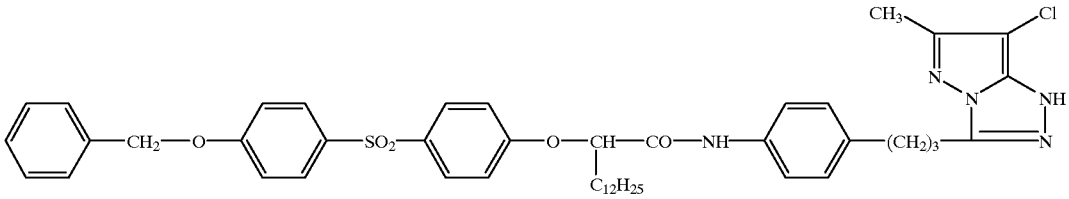
YM-1
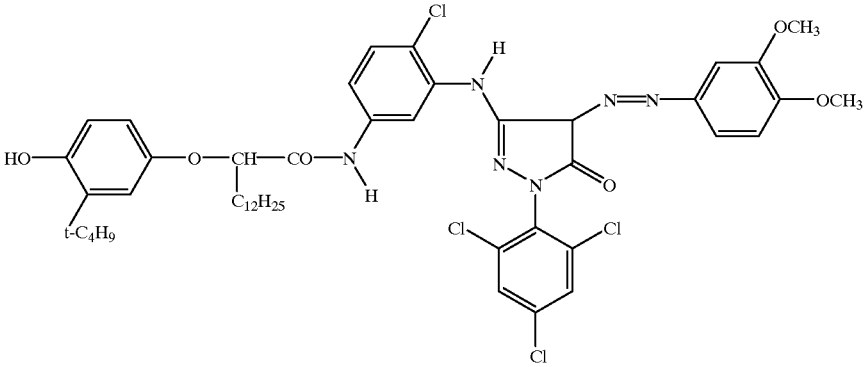
Y-1
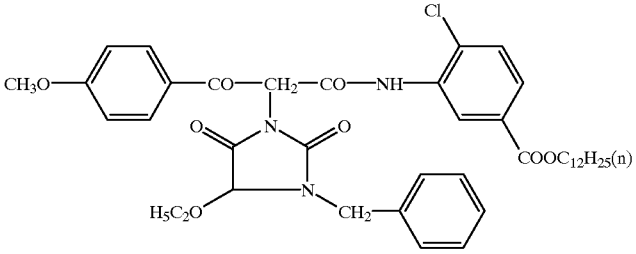

-continued
D-1
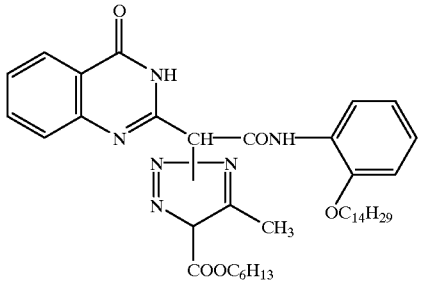
YC-1
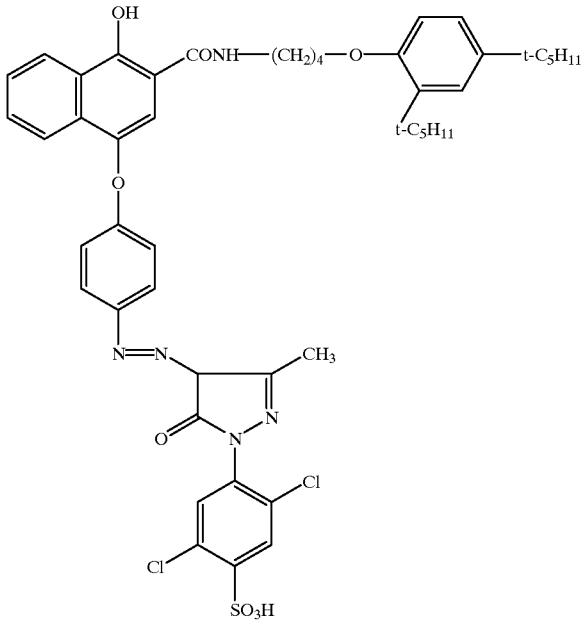
YM-2
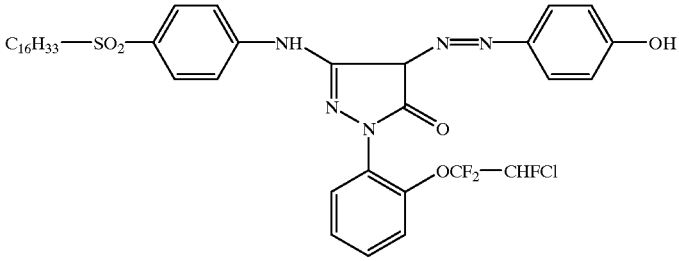
SC-1
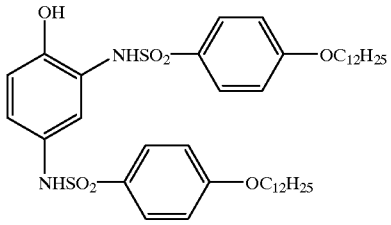

-continued

FF-1

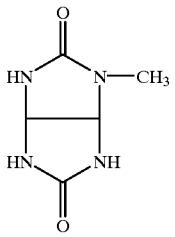

W-1

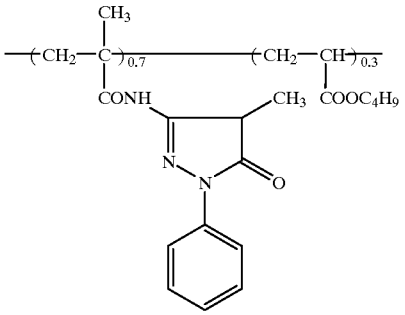

After exposure with a grey wedge, development is performed in accordance with *The British Journal of Photography,* 1974, pages 597 and 598.

Table 1 shows the changes made in layer structures 1B to 1M relative to layer structure 1A.

The compounds additionally introduced into the $4^{th}$ or $5^{th}$ layer are:

Compound 1

—HO—$CH_2CH_2$—S—($CH_2CH_2$—O—)$_5$—H (Development accelerator)

| Example | | Application rate of coupler C-2 in $4^{th}$ layer | 4th layer additionally contains | 5th layer additionally contains | Application rate of coupler C-2 in $5^{th}$ layer |
|---|---|---|---|---|---|
| A | not according to the invention | 0.19 | — | — | 0 |
| B | not according to the invention | 0.02 | — | — | 0.08 |
| C | not according to the invention | 0.19 | 1.5 mg/m$^2$ of compound 1 | — | 0 |
| D | not according to the invention | 0.19 | — | 3 mg/m$^2$ of compound 2 | 0 |
| E | not according to the invention | 0.19 | — | 200 mg/m$^2$ of compound 3 | 0 |
| F | not according to the invention | 0.19 | — | 50 mg/m$^2$ of compound 4 | 0 |
| G | not according to the invention | 0.19 | — | 30 mg/m$^2$ of compound 5 | 0 |
| H | according to the invention | 0.02 | 1.5 mg/m$^2$ of compound 1 | — | 0 |
| I | according to the invention | 0.02 | — | 3 mg/m$^2$ of compound 2 | 0 |
| J | according to the invention | 0.02 | — | 200 mg/m$^2$ of compound 3 | 0 |
| K | according to the invention | 0.02 | — | 3 mg/m$^2$ of compound 2 | 0.08 |
| L | according to the invention | 0.02 | — | 50 mg/m$^2$ of compound 4 | 0.08 |
| M | according to the invention | 0.02 | — | 30 mg/m$^2$ of compound 5 | 0 |

Compound 2

$HO—CH_2CH_2—S—CH_2CH_2—O—CH_2—C(CH_3)_2CH_2OH$

Compound 3:

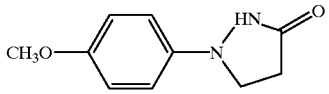

(Black-&-white auxiliary developer)

Compound 4:

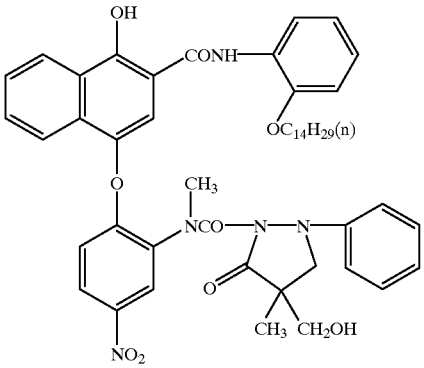

(ETAR coupler)

Compound 5:

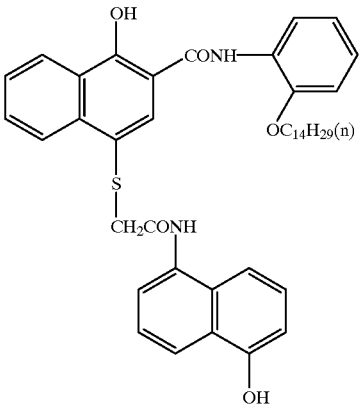

(ACR coupler)

The following values were obtained after exposure and development.

| Example | Relative sensitivity (red) | Gradation (red) | RMS grain (red) |
|---|---|---|---|
| A | 100 | 0.64 | 12.6 |
| B | 78 | 0.84 | 7.7 |
| C | 110 | 0.75 | 14.6 |
| D | 112 | 0.68 | 13.8 |
| E | 108 | 0.70 | 14.0 |
| F | 107 | 0.67 | 13.5 |
| G | 110 | 0.80 | 15.1 |
| H | 97 | 0.60 | 10.1 |
| I | 102 | 0.62 | 10.3 |

-continued

| Example | Relative sensitivity (red) | Gradation (red) | RMS grain (red) |
|---|---|---|---|
| J | 96 | 0.63 | 10.5 |
| K | 104 | 0.66 | 10.8 |
| L | 100 | 0.67 | 10.6 |
| M | 101 | 0.68 | 11.1 |

It is evident from examples 1H to 1M that, at identical sensitivity and gradation, the material according to the invention has improved grain in comparison with materials not according to the invention.

What is claimed is:

1. A color negative film which comprises a support, at least one blue-sensitive, yellow-coupling silver halide emulsion layer, at least one green-sensitive, magenta-coupling silver halide emulsion layer, and at least one red-sensitive, cyan-coupling silver halide emulsion layer, wherein at least one of the color-sensitive silver halide emulsion layers contain at least two sub-layers of differing photographic sensitivity, and said coupler application rate in the most highly sensitive layer of the color sensitive silver halide emulsion layer, of which there is at least one, and contain at least two sub-layers of differing photographic sensitivity, is no more than 0.05 mmol/$m^2$ and a compound selected from the group consisting of (a) a development-promoting compound, (b) an electron transfer agents (ETAR) couplers and (c) affinity for silver (ACR) couplers, is used in the same or an adjacent layer, which compound, on reaction with the developer oxidation product (DOP), releases a development-promoting compound from the group of ETAR or of binding groups having an affinity for silver (ACR).

2. The color negative film according to claim 1, wherein the development-promoting compound is a development accelerator introduced in a quantity of between 0.01 and 100 mg/$m^2$ into a protective layer immediately above the most highly sensitive sub-layer, which contains less than 0.05 mmol of color coupler/$m^2$.

3. The color negative film according to claim 1, wherein the development-promoting compound is a development accelerator introduced in a quantity of between 0.01 and 5 mg/$m^2$ into the most highly sensitive sub-layer, which contains less than 0.05 mmol of color coupler/$m^2$.

4. The color negative film according to claim 1, wherein the development-promoting compound is a black-&-white auxiliary developer introduced in a quantity of between 1 and 3000 mg/$m^2$ into a protective layer immediately above the most highly sensitive sub-layer, which contains less than 0.05 mmol of color coupler/$m^2$.

5. The color negative film according to claim 1, wherein the compound which releases a development-promoting compound on reaction with DOP is an ETAR coupler introduced in a quantity of between 0.01 and 500 mg/$m^2$ into the most highly sensitive sub-layer, which contains less than 0.05 mmol of color coupler/$m^2$.

6. The color negative film according to claim 1, wherein the compound which releases a development-promoting compound on reaction with DOP is an ETAR coupler introduced in a quantity of between 1 and 500 mg/$m^2$ into a protective layer immediately above the most highly sensitive sub-layer, which contains less than 0.05 mmol of color coupler/$m^2$.

7. The color negative film according to claim 1, wherein the compound which releases a development-promoting compound on reaction with DOP is an ACR coupler introduced in a quantity of between 0.01 and 50 mg/$m^2$ into the most highly sensitive sub-layer, which contains less than 0.05 mmol of color coupler/$m^2$.

8. The color negative film according to claim 1, wherein the ACR coupler introduced in a quantity of between 1 and 200 mg/$m^2$ into a protective layer immediately above the most highly sensitive sub-layer, which contains less than 0.05 mmol of color coupler/$m^2$.

9. The color negative film according to claim 1, wherein a protective layer arranged immediately above the most highly sensitive sub-layer, containing less than 0.05 mmol of color coupler/$m^2$ and contains said color coupler in a quantity greater than that in the most highly sensitive sub-layer.

* * * * *